US005118067A

United States Patent [19]

Gillanders

[11] Patent Number: 5,118,067

[45] Date of Patent: Jun. 2, 1992

[54] MOBILE CHRISTMAS TREE STAND WITH DETACHABLE LIQUID RESERVOIR

[76] Inventor: David D. Gillanders, 226 Viking Ave., Brea, Calif. 92621

[21] Appl. No.: 621,384

[22] Filed: Dec. 3, 1990

[51] Int. Cl.[5] ..... A47G 33/12

[52] U.S. Cl. ..... 248/527; 47/40.5

[58] Field of Search ..... 47/40.5; 248/519, 523, 248/524, 527

[56] References Cited

U.S. PATENT DOCUMENTS

| | | | |
|---|---|---|---|
| 1,662,091 | 3/1928 | Vuozzo | 248/524 |
| 1,750,367 | 3/1930 | Smith | 248/524 |
| 2,317,049 | 4/1943 | Ginka | 248/527 X |
| 2,524,450 | 10/1950 | Knaus | 248/523 |
| 2,628,801 | 2/1953 | Gunning | 248/96 |
| 3,051,423 | 8/1962 | Wagner et al. | 47/40.5 |
| 3,484,067 | 12/1969 | Fulper | 47/40.5 X |
| 4,610,356 | 9/1986 | Porter et al. | 47/40.5 X |
| 4,769,508 | 11/1990 | Reynolds | 47/40.5 |

FOREIGN PATENT DOCUMENTS

| | | | |
|---|---|---|---|
| 3701426 | 7/1988 | Fed. Rep. of Germany | 248/523 |

*Primary Examiner*—Carl D. Friedman
*Assistant Examiner*—Derek J. Berger

[57] ABSTRACT

A holder for Christmas trees which provides for ease of mobility with wheels and a removable handle. A detachable liquid reservoir is removable without disturbing the secured tree. A trunk anchor bolt enables a tree to be installed in a prone position.

3 Claims, 1 Drawing Sheet

MOBILE CHRISTMAS TREE STAND WITH DETACHABLE LIQUID RESERVOIR

BACKGROUND—FIELD OF INVENTION

The invention described herein relates to tree stands used to securely hold a Christmas tree and to provide a moisture supply for the tree.

BACKGROUND —DESCRIPTION OF PRIOR ART

Christmas tree stands which provide a liquid reservoir have commonly integrated the reservoir into the stand as a structural element which made removal of the reservoir from the part of the stand securing the tree impossible while a tree was installed in the stand. I cite the following prior patents as examples:

U.S. Pat. No. 4,006,560

U.S. Pat. No. 3,411,740

U.S. Pat. No. 4,571,881

Some other designs do not use the reservoir as a structural element but due to the position of the tree trunk while secured in the stand, the reservoir cannot be removed from the tree unless the tree is elevated temporarily. An example of this design is U.S. Pat. No. 4,771,978. It would be a great advantage if the tree stand were designed in such a way that the liquid reservoir was not a necessary structural element and the tree trunk position was such that the reservoir could be removed without disturbing the tree for the purposes of filling, emptying, or cleaning the reservoir.

Furthermore, prior art tree stands are stationary in nature and are not easily moved for purposes of:

(a) positioning the tree for the best viewing angle as trees typically have imperfections in uniformity;

(b) moving the tree to obtain greater access for the purpose of decorating and installing lights;

(c) moving the tree to clean up needles dropped on the floor;

(d) transporting the tree from an installation location elsewhere;

(e) final removal of the tree.

If a tree stand could be designed to be easily moved with little effort without compromising stability or permanency while resting in its desired position, it would be a great advantage to the user of the tree stand.

Additionally, prior art tree stands which have utilized retaining screws located distaly from the tree trunk end and radial to the trunk axis, have depended on sharp trunk end engagement points to hold the trunk end stationary while the retaining screws were adjusted to compensate for crooked trunks and cause the tree to stand straight. These engagement points depend on axial force to maintain engagement which is normally provided by gravity when the tree is in its upright position. It would be a great advantage if the tree trunk end could be easily attached to the tree stand with a means not dependent on gravity. It would then be possible to install a tree into a stand in a prone position and by using a lever provided, manipulate the tree into an upright position.

OBJECTS AND ADVANTAGES

Accordingly, several objects and advantages of the present invention are:

(a) to provide a Christmas tree stand with a liquid reservoir where the reservoir may be easily removed from the stand without disturbing the secured tree;

(b) to provide a Christmas tree stand which is mobile and can be easily moved with the secured tree by means of a detachable lever;

(c) to provide a Christmas tree stand which can be affixed to a prone tree and by means of a lever manipulated upright, thus making it possible for the user of the tree stand to install a large tree unassisted.

Further objects and advantages will become apparent from a consideration of the ensuing description and drawings.

DRAWING FIGURES

REFERENCE NUMERALS IN DRAWINGS

Figure 1:
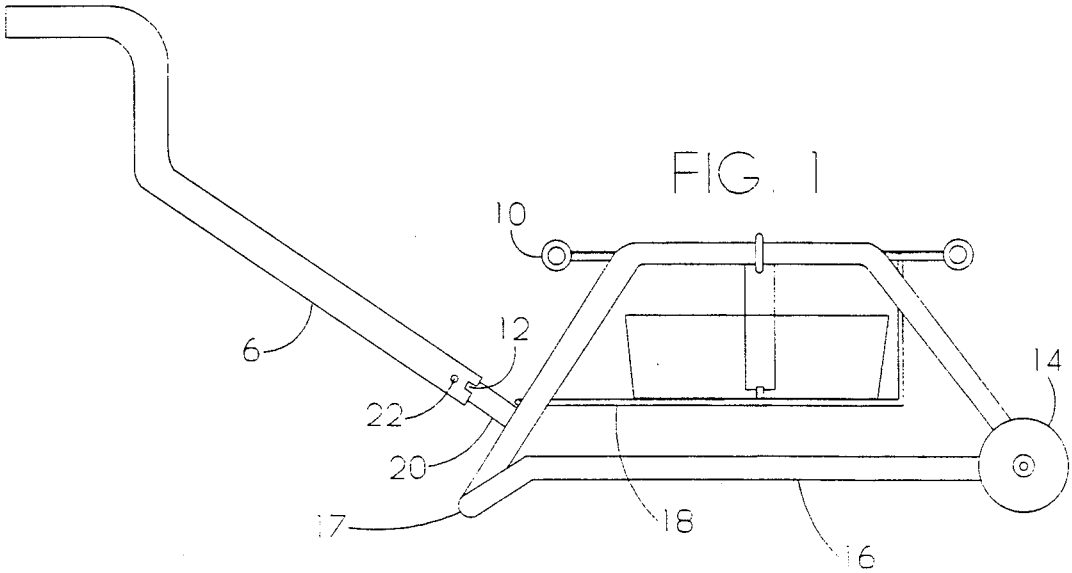
FIG. 1 is a side view of the tree stand with liquid reservoir in place and handle attached.

| Reference Numerals in Drawings | |
|---|---|
| 6 | handle |
| 8 | liquid reservoir |
| 10 | retaining screws |
| 12 | drive notch |
| 14 | wheel |
| 16 | frame |
| 17 | contact surface |
| 18 | reservoir support frame |
| 20 | handle engagement lug |
| 22 | handle retaining pin |
| 24 | trunk anchor bolt |
| 26 | trunk engagement spikes |
| 28 | hub nut |
| 30 | trunk cleat |
| 32 | trunk throat |
| 34 | axle |
| 36 | support leg |
| 38 | strut |

DESCRIPTION—FIGS. 1, 2, 3

Figure 2:
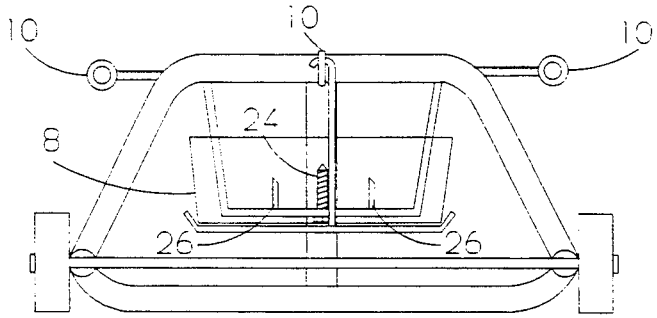
FIG. 2 is a rear view, with handle removed, of the tree stand showing clearly the trunk engagement spikes and trunk anchor bolt.
Figure 3:
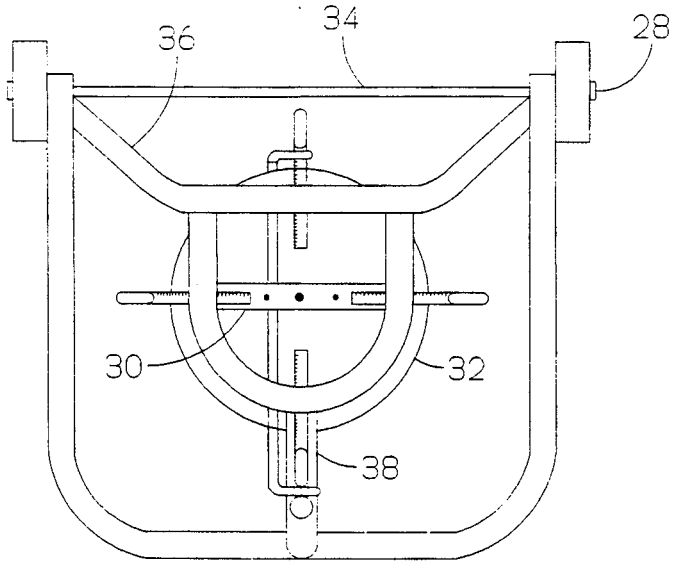
FIG. 3 is a top view, with the handle removed, of the tree stand showing clearing all trunk retaining screws.

A typical embodiment of the tree stand of the present invention is illustrated in FIG. 1 (side view), FIG. 2 (rear view), and FIG. 3 (top view). A tubular base 16 forms a large U shaped structure to provide stability and contacts the floor at contact surface 17. A solid axle 34 spans the open end of the U shaped base and supports two wheels 14 which are each retained to axle with a nut 28. A curved trunk throat 32 is disposed centrally over base and secured to base through a tubular support leg 36 and a tubular strut 38. Threaded holes in trunk throat and support leg accept a retaining screw 10 shown in four equally spaced locations. A trunk cleat 30 descends from throat to support tree trunk end and contain trunk anchor bolt 24. A trunk engagement spike 26 is affixed to cleat on either side of anchor bolt. A detachable liquid reservoir 8 is disposed below and surrounding trunk cleat, being supported by a reservoir support frame 18. A tubular handle 6 demountably couples to a handle engagement lug 20 and is retained by a handle retaining pin 22. A drive notch 12 on handle is intended to engage retaining screw eye so that handle may be used as a wrench to adjust retaining screw.

OPERATION—FIGS. 1. 2. 3

The subject tree stand may be affixed to the tree while tree is in a prone position by engaging trunk engagement spikes into tree trunk end and inserting and rotating clockwise the trunk anchor bolt 24 until fully seated into the trunk end. One then manually threads in a clockwise direction the retaining screws 10 until contact is made with the trunk outer edge. One then attaches handle 6, securing it to the lug 20 with the handle retaining pin 22. Force is then manually applied to the handle in a downward direction causing the base to fulcrum on the wheels 14 until the tree and stand reach an upright position as show in FIG. 1. One now removes the handle from the lug and using the drive notch 12 and the handle as a wrench, adjusts the retaining screws causing the tree to tilt axially until a position of straightness is achieved.

Alternatively, the tree may be installed into the stand in the more conventional method by lifting the tree and lowering the trunk end into the upright stand. Again, one adjusts the retaining screws for straightness of the tree.

One removes the liquid reservoir by grasping front curved portion of the reservoir support frame 18 and disengaging it from the strut 38. One then may lift the frame slightly, disengaging it from the retaining screw 10, and allow the reservoir and frame to descend to the floor where the reservoir may be easily slid out either side of the stand.

SUMMARY, RAMIFICATIONS, AND SCOPE

Accordingly, the reader will see that the tree stand of the invention is a superior device which has the unique features of:

A liquid reservoir which may be easily removed without disturbing the secured tree for the purposes of filling, emptying before tree removal to prevent spilling, and cleaning.

Mobility to enable the tree to be safely and conveniently moved.

Installation on a tree which is laying down, enabling one to erect a tree unassisted.

A tree stand which by design is exceptionally stable, strong, and lightweight.

Although the description above contains many specificities, these should not construed as limiting the scope of the invention but as merely providing illustrations of some of the presently preferred embodiments of this invention. Accordingly, the scope of the invention should be determined not by the embodiment(s) illustrated, but by the appended claims and their legal equivalents.

I claim:

1. In combination with a tree, a Christmas tree stand having a liquid reservoir, means providing for removal and attachment of said reservoir while said tree is installed in said stand without altering the position of said tree or said stand, said means for removal and attachment comprising an elevated tree trunk support cleat and a reservoir support frame demountably attached to said stand to support said reservoir above a floor surface and proximal to said tree in a generally coaxial relationship to said tree.

2. The combination of claim 1 wherein said trunk support cleat provides vertical support for said tree, is independent in structure to said reservoir, and is constructed to provide for access of liquid contents of said reservoir to said tree.

3. The combination of claim 1 wherein said reservoir support frame includes hooks which attach to said trunk support cleat and support said reservoir in an elevated position and in a generally coaxial relationship to said tree to provide liquid nourishment to said tree.

* * * * *